US010814163B2

(12) United States Patent
Sinegal

(10) Patent No.: US 10,814,163 B2
(45) Date of Patent: Oct. 27, 2020

(54) EXERCISE APPARATUS AND METHOD

(71) Applicant: Allen Sinegal, New Orleans, LA (US)

(72) Inventor: Allen Sinegal, New Orleans, LA (US)

( * ) Notice: Subject to any disclaimer, the term of this patent is extended or adjusted under 35 U.S.C. 154(b) by 0 days.

(21) Appl. No.: 16/030,529

(22) Filed: Jul. 9, 2018

(65) Prior Publication Data

US 2020/0009420 A1 Jan. 9, 2020

(51) Int. Cl.
*A63B 23/02* (2006.01)
*A63B 21/062* (2006.01)
(Continued)

(52) U.S. Cl.
CPC ..... *A63B 23/0233* (2013.01); *A63B 21/0083* (2013.01); *A63B 21/0632* (2015.10);
(Continued)

(58) Field of Classification Search
CPC ..... A63B 23/0216; A63B 23/0222; A63B 23/0227; A63B 23/0233; A63B 23/0238; A63B 23/03508; A63B 23/04; A63B 23/0482; A63B 23/0494; A63B 21/00058; A63B 21/0065; A63B 21/00069; A63B 21/008; A63B 21/0083; A63B 21/0085; A63B 21/0087; A63B 21/0435; A63B 21/0442; A63B 21/045; A63B 21/0455; A63B 21/0628; A63B 21/063; A63B 21/15; A63B 21/154; A63B 21/22; A63B 21/222; A63B 21/227; A63B 21/4001; A63B 21/4011; A63B 21/4013; A63B 21/4015; A63B 21/4033; A63B 21/4034; A63B 21/4039; A63B 21/4041; A63B 21/4045; A63B 21/4047; A63B 21/4049; A63B 22/0015; A63B 22/0017; A63B 22/0023; A63B 22/0025; A63B 22/0046; A63B 22/0087; A63B 22/0089; A63B 22/14; A63B 22/18; A63B 2208/0209; A63B 2208/0247; A63B 2208/0261; A63B 2225/093; A63B 2225/09; A63B 2022/0041; A63B 2022/0092;
(Continued)

(56) References Cited

U.S. PATENT DOCUMENTS 4,349,193 A * 9/1982 Lambert, Jr. ..... A63B 23/0211 482/100
4,515,363 A 5/1985 Schleffendorf
4,538,807 A 9/1985 Rice
6,485,398 B1 * 11/2002 Kreft ..... A63B 23/03575 482/147
(Continued)

*Primary Examiner* — Jennifer Robertson
*Assistant Examiner* — Kathleen Vermillera
(74) *Attorney, Agent, or Firm* — Keaty Law Firm LLC

(57) ABSTRACT

A weighted hip and lower back exerciser, for use in isolating and working out a targeted portion of the lower back or gluteal muscles through weighted internal and external rotation, that includes a framework, a upper body support section, a weight system, a the weighted leg pivot section. A user secures one of his/her legs onto a leg pad and pivots the leg pad by rotating his/her hip and lower back. The leg pad is connected to weights by a band passing through a pair of pulleys and a pulley cord guide. When the user swivels the leg rest, the user tenses the band thus lifting the weights, and resistance is generated. The user will isolate the rotational movement to the hip and lower back by leaning onto a chest support and resting his/her arms on an arm support mounted on a vertical rack above the weight assembly.

16 Claims, 5 Drawing Sheets

(51) Int. Cl.

| | |
|---|---|
| ***A63B 21/008*** | (2006.01) |
| ***A63B 21/00*** | (2006.01) |
| ***A63B 23/035*** | (2006.01) |
| ***A63B 23/04*** | (2006.01) |

(52) U.S. Cl.
CPC ..... *A63B 21/151* (2013.01); *A63B 21/158* (2013.01); *A63B 21/4034* (2015.10); *A63B 21/4035* (2015.10); *A63B 21/4039* (2015.10); *A63B 23/03508* (2013.01); *A63B 23/0494* (2013.01); *A63B 2208/0209* (2013.01); *A63B 2225/093* (2013.01)

(58) Field of Classification Search
CPC ..... A63B 2022/0094; A63B 2022/185; A63B 2023/003; A63B 2023/006; A63B 26/00
See application file for complete search history.

(56) References Cited

U.S. PATENT DOCUMENTS

| | | | | |
|---|---|---|---|---|
| 7,708,675 | B2 * | 5/2010 | Miskech | A63B 21/00181 482/140 |
| 7,878,957 | B1 | 2/2011 | Chen | |
| 8,052,583 | B1 | 11/2011 | Chu | |
| 8,066,624 | B1 * | 11/2011 | Stroup | A47C 9/002 297/338 |
| 8,870,726 | B2 | 10/2014 | Watterson et al. | |
| 9,205,298 | B2 | 12/2015 | Hockridge et al. | |
| 9,597,546 | B2 * | 3/2017 | Maholmes | A63B 23/0211 |
| 9,707,448 | B2 | 7/2017 | Hockridge et al. | |
| 2012/0040812 | A1 * | 2/2012 | Liao Lai | A63B 23/0222 482/142 |
| 2014/0045664 | A1 * | 2/2014 | Hockridge | A63B 26/00 482/142 |
| 2016/0279459 | A1 * | 9/2016 | Walker | A63B 21/4047 |

* cited by examiner

EXERCISE APPARATUS AND METHOD

BACKGROUND OF THE INVENTION

This invention relates to exercise machines, and more particularly, to exercise machines using weights to narrowly target a specific area of a human body during exercise or physical therapy.

In physical therapy, a patient often needs specific and detailed attention paid to a certain area of the body. Therapists work with the patient to train and rebuild the affected area by providing movements and exercises which target the affected muscle groups in the area. Therefore, an effective physical therapy machine used in lower back and hip therapy should be able to provide a successful workout, while accommodating the unique needs of those with lower back or hip problems to prevent further injury. The factors a physical therapy machine must take into account include, but are not limited to, potential variation in the size of the affected area, severity of patients' pain, the physical strength in the affected muscle groups, a potential lack of proprioception, and varying tolerances for physical stress. These issues may be further exasperated by a physical therapy patient also being physically weak or in need of physical therapy in other areas of the body. Thus, an exercise machine used in physical therapy must be able to adjust to fit the holistic requirements of the physical therapist's treatment plan to prevent further injury to the patient while building up the required areas of the body.

Known solutions to the above problem provide for exercise machines that either target the hip or lower back in whole, are not weighted, do not provide internal or external rotation, and/or do not provide a level of support and stability necessary to isolate the affected areas to a degree beneficial for use through the patients' journey through physical therapy.

For example, U.S. Pat. No. 9,205,298, issued on Dec. 8, 2015 to assignee Hoist Fitness Systems, Inc., covers an "Exercise Machine with Unstable User Support." The unstable user support device was created by inventors Bruce Hockridge, Jeffrey O. Meredith, and Thao V. Doan, and was designed for mounting on a rotary torso exercise machine. The device has a base or mounting bracket and an unstable user support platform configured for engagement by the user and pivotally mounted on the base for pivotal movement through a limited angular range about a non-vertical pivot axis. The pivoting movement may be a side-to-side tilting movement. Stops between the base and the unstable user support platform control the amount of pivoting movement. The arrangement provides a degree of instability to the platform, which allows for a greater challenge to the user's core muscles in balancing the platform while performing an exercise motion.

U.S. Pat. No. 8,052,583 was issued on Nov. 8, 2011 to assignee Cheng-Kang Chu for a "Swivel Exerciser." The swivel exerciser, created by inventor Jao-Hsing Tsai, includes a base with two front legs, a rear leg, a head tube in a center of a front portion, and two spaced hand grips on a top end of the head tube. A sector-shaped plate on a top of the base includes two central pivot members. A curved rail is around a curved edge of the sector-shaped plate, with the rail being fixedly secured to the top of the base. Two pivotal arms are rearward splayed out of the pivot members respectively. Two knee plates are disposed on the other ends of the arms, and each includes a wheel disposed on the rail and adapted to move therealong. A projection is disposed at a joining portion of each arm and knee plate, and includes a through hole. An inverted U-shaped bridge member is adapted to insert into the through holes to interconnect the projections or not.

U.S. Pat. No. 7,878,957, as issued to Yi-Fan Chen on Feb. 1, 2011, discloses a "Multi-Functional Exercising Machine." The multi-functional exercising machine has a supporting device, a rotating device, and a handle device, and the supporting devices includes a base and a pivotal mount. This pivotal mount is formed on the base, and features a positioning panel. The rotating device, in turn, is connected to the supporting device and has a mounting frame, two guiding bars, a limiting rod, and a sliding mount. The mounting frame is connected to the pivotal mount and has a pivotal shaft, a connecting panel, and a positioning post. The guiding bars are connected to the mounting frame, and the sliding mount is mounted on the guiding bars and has a sliding frame and a hassock. The sliding frame is mounted on the guiding bars and has two rollers, two limiting arms, and a connecting pin. The hassock is mounted on the sliding frame, and the handle device is connected to the supporting device. When using the exercise machine, the legs of a user are positioned in the mounting recesses of the hassock, and the hands of the user grip the handle frame. When removing the positioning post from the positioning panel and the connecting panel, the pivotal shaft of the mounting frame can be rotated relative to the pivotal mount. Then, the rotating device can be rotated relative to the supporting device and the handle device. The user can thus twist his waist and swing his legs while the rotating device is rotating relative to the supporting device and handle device.

U.S. Pat. No. 6,485,398 was issued to Paul H. Kreft on Nov. 26, 2002, disclosing an "Exercise Apparatus." The apparatus was designed to strengthen the abdominal and oblique muscles in a related state by kneeling and twisting the lower torso. The system includes a height-adjustable, contoured knee rest rotatingly mounted on a base. Handles extend from the base to where a user may comfortably grasp the handles while kneeling on a knee rest. The user exercises with the apparatus by urging the user's lower torso to rotate the knee rest. Rotation may be resisted by increasing the inertia of the knee rest with weights suspended from weight arms connected to the knee rest. Specifically, the '398 patent covers an exercise apparatus featuring (a) a base, (b) a knee rest rotatably mounted on the base, (c) a first stationary cylinder mounted on the base, (d) a second cylinder rotatably coupled to the first stationary cylinder, where the second cylinder is fixed relative to the knee rest, and (e) a weight arm, mounted on the second cylinder, for receiving a free weight and a first grip, fixed relative to the base, arranged for a user to grasp when kneeling on the knee rest.

U.S. Pat. No. 4,515,363 issued on May 7, 1985 to John J. Schleffendorf, and covers a "Weight Lifting Exerciser." The '363 patent discloses an exercising machine for especially training the muscles of the leg, and includes a base on which a pair of support tables is rotatably carried, one for each foot, a vertical standard on the base adapted to provide fixed hand grips for a standing user (or a seat for a sitting user), and a pair of resistance devices preferably formed by a selectable number of weights. Each resistance device is respectively connected by a cable and pulley system to one of the support tables to provide a variable reactive force as the associated support table is moved out of a neutral position. The seat and hand grips can be set at a selected height, the hand grips can be set at three positions in one horizontal plane, and the foot-supporting portion of each support table can be placed in a selected angular position by which the neutral or starting position is picked. Given the configuration of the machine, it can be used close to a wall, providing a compact option for a residential user or a user otherwise concerned with spacing restrictions.

U.S. Pat. No. 4,538,807 was issued on Sep. 3, 1985 to assignee The Max Rice Corporation, and covers a "Torso Building Exercise Machine." The system provides for two primary embodiments, each created by inventor Max Rice. In one embodiment of the torso building exercise machine, the system includes (a) a stationary base, (b) a horizontally disposed rotatable turntable mounted on the base, where the turntable has a single degree of freedom about its vertical axis, (c) posts for holding adjustable weights located near the periphery of the turntable, and (d) an upright stationary stanchion mounted on the base, where the stanchion carries a headrest and horizontal handholds in a curved array at various vertical levels and is selectively greppable by a person while performing various twisting exercises on the turntable. A second embodiment of the system provides a torso building exercise machine with (a) a stationary base, (b) a horizontally disposed rotatable turntable mounted on the base, with the turntable having a single degree of freedom about its vertical axis, (c) multiple tank-like compartments for holding an adjustable amount of a fluid located near the periphery of the turntable, and (d) an upright stationary stanchion mounted on the base, where the stanchion carries an array of horizontal handholds at various vertical levels and are selectively grippable by a person while performing various twisting exercises on the turntable.

U.S. Pat. No. 8,870,726 was issued on Oct. 28, 2014 to assignee ICON IP, Inc. for a "System and Method for Exercising." The abdominal exercise device, which was created by inventors Scott R. Watterson, William T. Dalebout, and Michael Olson, includes a support structure, a track movable relative to the support structure, and a body support member movable relative to the support structure and track. A locking mechanism attaches to the track, and selectively secures the track at a fixed orientation relative to the support structure. In a first state, the locking mechanism restricts the track from rotating relative to the support structure, and in a second state, the locking mechanism allows the track to rotate relative to the support structure. In using the exercise device, the user may obtain any of three motions. A first motion is provided by sliding the body support member along the track; a second support motion is provided by rotating the track relative to the support structure; and a third motion is a combined motion in which the body support slides along the track and the track rotates relative to the support structure.

U.S. Pat. No. 9,707,448 issued to assignee Hoist Fitness Systems, Inc. on Jul. 18, 2017, and covers an "Exercise Machine with Movable User Support." The exercise machine, invented by Bruce Hockridge et al., has a two-directional pivoting user support assembly featuring a user support or platform that supports the user and pivots about a first pivot axis during an exercise movement. The machine is also pivotable about at least one second pivot axis to involve the user's core muscles in balancing and maintaining the user support in a stable position. A manually operable locking device with a simple flip switch lever is provided, which allows for selectively locking the user support against rotation about the second pivot axis. This lever allows the user to easily choose whether to perform the exercise with a stable support, or to add a level of difficulty by using the unstable seat mode and exercising core muscles during the exercise.

U.S. Pat. No. 9,597,546 entitled an "Abdominal Twist Exercise Device" issued to Spencer L. Maholmes on Mar. 21, 2017. The abdominal twist exercise device includes a device frame, front and rear rotational axles, a main handle bar, a rotation converter, an adjustable gear, a disengaging lever, a weight, a weight bar, a support rail, a safety handle bare, rotation counters, and a user platform, such that when the main handle bar rotates to one side, the user platform rotates to an opposing side. A rotation converter can include a front chain sprocket, an intermediate rotational axle, an intermediate chain sprocket, a roller chain, an intermediate gear, and a rear gear, or a front belt sprocket, a rear belt sprocket, and a twisted belt, connecting the sprockets. Optionally, the front and rear axles can be telescoping. The '546 patent was designed, in part, to allow for abdominal muscle exercise without reliance on strenuous crunching movements, and to allow for abdominal muscle exercise for persons with existing lower back problems.

While the above discussed approaches may be beneficial in certain circumstances, there exists a need for an easy-to-operate and effective weighted hip and lower back exerciser for working out an isolated and targeted portions of a user's hip and lower back, especially in the field of physical therapy.

One of the objects of this invention is to provide a weighted hip and lower back exerciser for use in isolating and working out, a narrowly targeted portion of the lower back or hip area through weighted internal and external rotation. It is envisioned that this invention will be particularly beneficial to physical therapy patients who need either hip or lower back treatment, or both, since it is directed to a specific side or area of the hip and lower back. As this weighted hip and lower back exerciser provides weighted resistance to a rotational movement of the targeted area, it effectively isolates specific portions of the hip and lower back of the user, strengthening the user's muscles.

The present invention achieves these objectives by specifically adjusting to support the patient's physical build, by being adjustable to narrowly target the affected area, and by providing a large variance of resistance levels.

SUMMARY OF THE INVENTION

It is therefore an objective of the present invention to provide an exercise apparatus that allows effective workouts of the lower back or hip by providing resistance to a targeted rotational movement in the hip or lower back area.

It is further an objective of the present invention to provide a targeting mechanism to narrowly isolate areas of the hip and lower back by providing a pivoting base rotated by only one of the user's legs to target the chosen area with range of movement dependent on the force created by a user's rotational movement.

It is further an objective of the present invention to provide a high degree of support for the user by providing an adjustable upper body support system for the user.

It is further an objective of the present invention to accommodate varying levels of physical strength and body types by providing a high level of adjustability and high ease of use.

The present invention achieves these objectives by providing a weighted hip and lower back exerciser comprising: a pivoting knee rest for a lower leg of the user; an easily adjustable pivot point for pivoting knee rest; adjustable weighted resistance to pivoting motion of a leg rest; adjustable chest support pads which adjust to and support a forward lean of the user; and handles for the user to grip to further anchor the user in place and limit rotational movement of the body.

This present invention provides an easy to operate, but highly effective, weighted exercise machine for targeting an area of the hips or lower back in physical therapy patients. The weighted hip and lower back exerciser solves the problem of isolating and working out the necessary gluteal muscles or lower back groups while stabilizing the rest of the user's body. The weighted hip and lower back exerciser solves this problem through engaging the user's lower leg in a pivoting knee rest to directly affect the targeted area of the hip and or lower back, while supporting the rest of the user's body by a torso support assembly.

BRIEF DESCRIPTION OF THE DRAWINGS

Reference will now be made to the drawings, wherein like parts are designated by like numerals, and wherein.

DETAILED DESCRIPTION OF THE INVENTION

Figure 1:
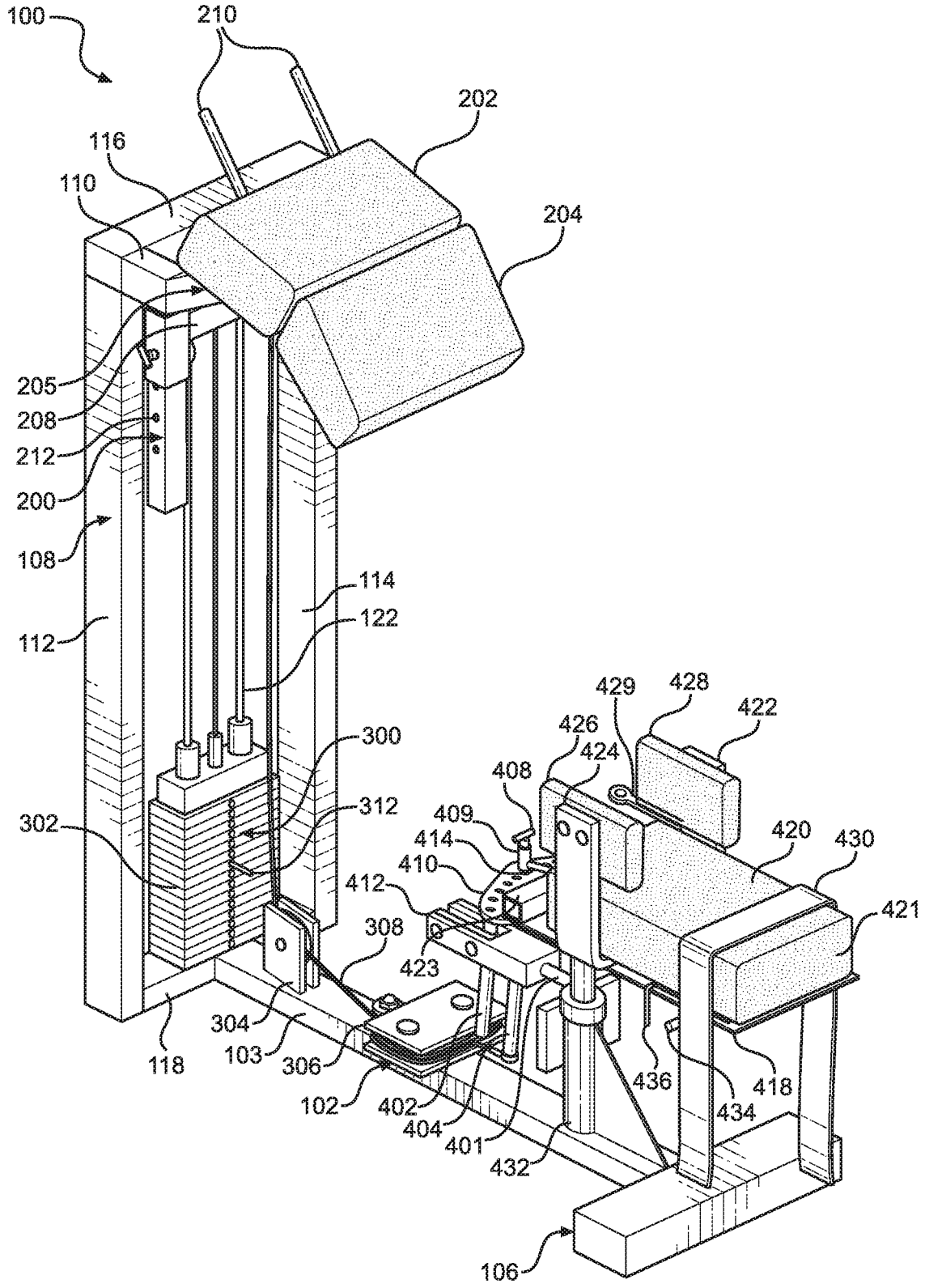
FIG. 1 is a perspective view of a preferred embodiment of the exercise machine according to the present invention.

Referring to FIGS. 1-5 generally, the drawings depict a perspective view of the weighted hip and lower back exerciser 100 of the present invention. The weighted hip and lower back exerciser comprises four main sections: a horizontal base configured for positioning on a floor as an upright open frame, or framework section, an upper body support section, a weight assembly, and a weighted leg pivot section. The base 102 has a T-shaped configuration having an elongated base bar 103 and a base cross bar 106. The framework is attached to one end of the base bar 103 opposite the frame cross bar 106.

The framework comprises a vertical rack 108 supporting the weight assembly 300. The weight assembly comprises one or more weights 302, which are suspended by the vertical rack 108. The vertical rack 108 is formed as an open rectangular body having a pair of parallel vertical frame members 112, 114 and a pair of transverse horizontal frame members: an upper horizontal frame member 116 and a lower horizontal frame member 118, both affixed to the vertical frame members 112, 114.

The weights 302 are suspended by suitably strong cables 122 from the upper horizontal frame member 116. The weight assembly 300 rests on the lower horizontal frame member 118 in an idle position shown in FIGS. 1-4. The number of individual weights 302 lifted during exercises can be adjusted by the user or a therapist by moving an adjustment pin 312 up or down for engagement with individual weights 302.

An extension bar 110 is affixed to the upper horizontal frame member 116, extending outwardly from the vertical rack 108. The extension bar 110 is cantilevered from the upper frame member 116. An adjustment arm 200 is attached to a free end of the extension bar 110, extending vertically downwardly therefrom. The adjustment arm comprises a hollow body with a plurality of vertically spaced-apart openings 212. A trunk support bar 208 is secured to the adjustment arm 200 by a vertically movable sleeve 214, which is attached to the trunk support bar 208. The sleeve 214 is configured to surround the adjustment arm 200 and slidably move along the adjustment arm 200. The sleeve 214 has an opening 216, which receives a securing pin 215. The securing pin 215 is inserted into aligned openings 212 and 216 selectively adjusting vertical position of the trunk support bar to accommodate a user's preference.

An arm pad 202 and a torso pad 204 are supported by a transverse bar 206, which is cantilevered from the trunk support bar 208. The transverse bar 206 is telescopically extendable allowing the user to move the torso pad 204 toward and away from the vertical rack 108. A rotating knob (not shown) releases the telescoping part of the transverse bar and permits the user to move the torso pad 204 to the desired extension. In one aspect of the invention, the arm pad 202 and the torso pad 204 are forwardly inclined for the user's comfort. The arm pad 202 carries a pair of grip handles 210.

The weight assembly 300 is operationally connected to a pulley assembly, which comprises a lower pulley 304 resting on the base 102 forwardly from the weight assembly and an upper pulley 310 mounted on the vertical rack above the weight assembly. A cord, or cable 308 is wound on the pulleys 310 and 304 extending upwardly to attach at one end to the weight assembly 300. The cord 308 passes through a horizontal cord guide 306, which is also attached to the base 102 a distance from the pulley lower 304. The opposite end of the cord is firmly attached to a downwardly extending cord attachment arm 404, which moves along with a leg rest assembly, as will be described in more detail hereinafter.

The leg pivot section comprises a vertically adjustable and horizontally pivotal leg rest 420 supported on the base 102 by a hydraulic unit having a hydraulic cylinder barrel 432 and a hydraulic piston or rod 433 moving back and forth within the barrel. The hydraulic unit allows vertical adjustment of the leg rest 420 in relation to the base 102. A hydraulic unit handle 434 is operationally connected to the hydraulic unit. By pivotally moving the hydraulic unit handle 434, the user can lift the leg rest 420 to a desired height in relation to the base 102. By pivotally moving the hydraulic unit handle 434 and slightly pressing on the leg rest 420, the user overcomes resistance of the piston and lowers the leg rest 420 downwardly to a desired position in relation to the base 102.

Angular position of the leg rest can be adjusted by lifting a distant end 421 upwardly from a seat plate 418. A lifting rod 435 mounted under the leg rest 420 forces the distant end 421 up and down. A lifting grip 436 is attached to the lifting rod 435 and extends downwardly below the seat plate 418. The user grasps the lifting grip 436, pivoting it and moving the distant end of the leg rest 420 to be incrementally inclined to accommodate the user. The opposite end of the leg pad 420 remains securely attached to the seat plate 418.

The leg pivot section also comprises a pair of knee pads 426, 428 positioned on opposite sides of the leg rest 420. The knee pads 426, 428 are secured above the leg rest 420 by upright supports 424, 422, respectively. One of the knee pads is stationary, while the second knee pad is horizontally slidable. In the illustrated embodiment, the knee pad 422 slides toward and away from the leg rest 420 using a tubular receptacle 423 receiving a horizontal extension of the upright support 422. The tubular receptacle 423 is mounted in front of the leg rest 420. A knob 429 attached to the upright support 422 releases engagement of the upright support 422 from the receptacle 423 and allows the user to move the upright support toward and away from the opposing upright support 424. Of course, the upright support 424 can be made slidable, if desired. It is preferred though that at least one knee pad be laterally movable to accommodate different users.

Figure 3:
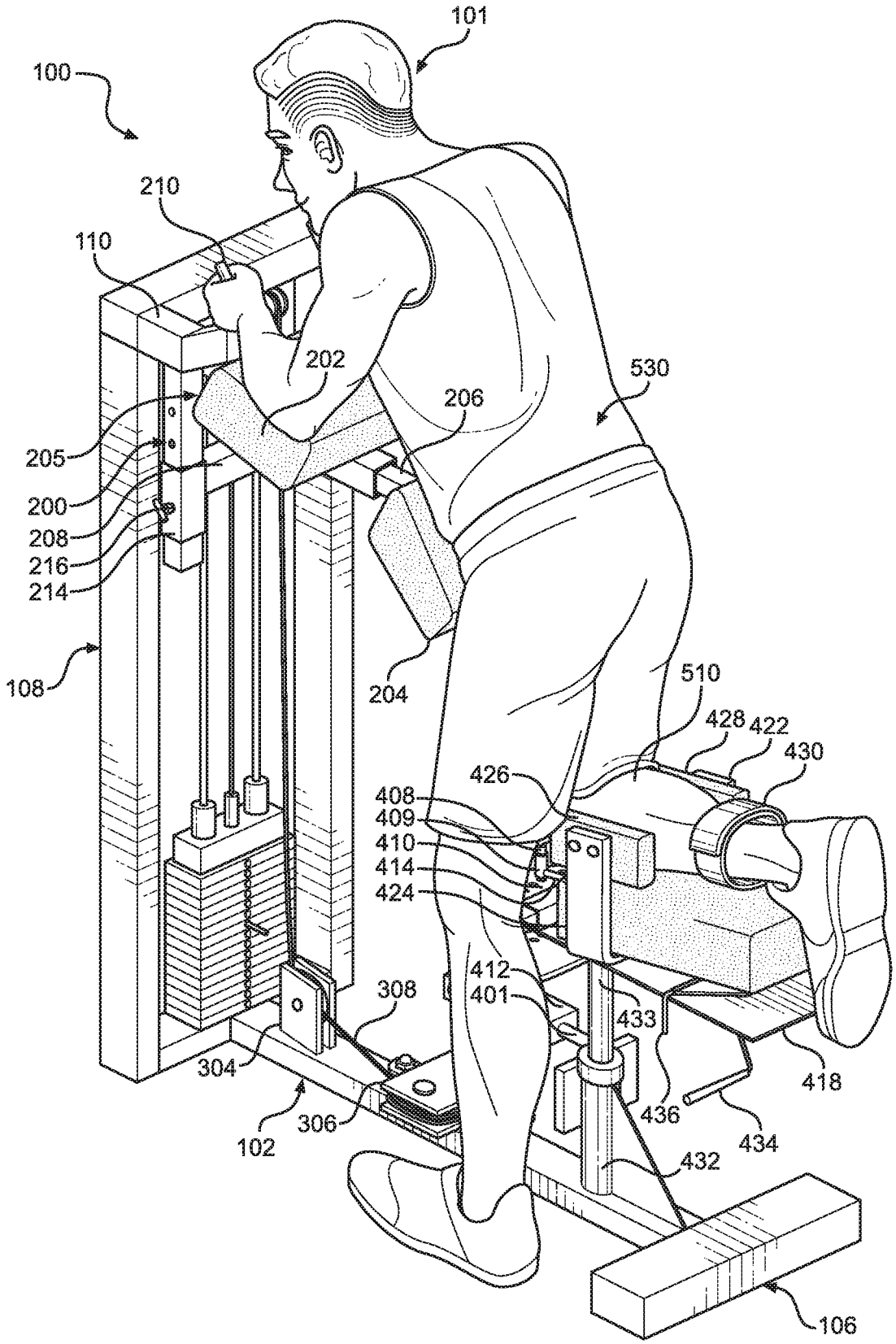
FIG. 3 is perspective view of a preferred embodiment of the present invention illustrating use of the exercise machine.

A flexible strap 430 is attached to the leg rest 420. The strap is configured to be placed about the user's leg, as shown in FIG. 3, and secure a position of the leg on the leg rest 420. The strap 430 can be provided with a buckle, hood-and-loop fasteners, or other securing means to allow the strap to be easily adjusted on the user's leg.

A planar pivotal adjustment plate 410 is attached to a proximal end of the seat plate 418. The pivotal adjustment plate 410 is provided with a plurality of spaced-apart openings 413 that are formed along a wide radius arc. A removable locking pin 408 is inserted into a desired opening 413 allowing the user's leg to follow a small arc or a wide arc of swivel depending on the position of the locking pin 408.

A horizontally-oriented U-shaped bracket 412 is positioned under the adjustment plate 410. A stabilizing rod 402 is secured to a bottom of the adjustment plate 410 and extends at a right angle downwardly therefrom. The stabilizing rod 402 passes through a channel formed by the U-shaped bracket and is restricted in side-to-side movements by the sides of the U-shaped bracket 412. As a result, the pivotal movement of the leg rest assembly is limited by the locking pin 408 engaged in any of the adjustment plate opening 413 and by the stabilizing rod 402 moving within the confines of the U-shaped bracket channel.

A back of the U-shaped bracket 412 is connected to rearwardly extending horizontal bracket-carrying rod 401. The U-shaped bracket is cantilevered from one end of the bracket-carrying rod 401. An opposite end of the bracket-carrying rod 401 is affixed to the piston 433 of the hydraulic unit. The cord attachment arm 404 is rigidly attached to the bottom of the U-shaped bracket 412 and transmits the pivotal movement of the leg rest 420 as a pulling force on the cord 308. The leg rest 420, the adjustment plate 410, the bracket 412, and the cord attachment arm 404 move as one unit when the leg rest is pivoted about a desired arc. As a result, the user has to overcome resistance of the cord and the weights when moving the leg side-to-side. Both the lower back 530 and the gluteal muscles of the user are exposed to resistance exercises.

To further stabilize the exercise apparatus, a buttress plate 105 is fitted between the hydraulic cylinder barrel 432 and the frame cross bar 106. The buttress plate 105 has a right-triangular configuration, with its vertical side attached to the hydraulic cylinder barrel 432, and the base attached to the elongated frame bar 103.

The preferred embodiment of the weighted hip and lower back exerciser is highly adjustable and is able to provide a high level of targeted and isolated resistance to a pivoting motion of the hip and lower back while supporting other areas of the body.

Although an embodiment of the present invention need not be adjustable, but can be made fixed to target a predefined narrow area of the hips or lower back area 530, the preferred embodiment of the weighted hip and lower back exerciser is adjustable with regards to at least six aspects: arm pad 202, angled chest pad 204, the pivot locking pin 408 position, the height of the leg rest 420, fit of second knee pad 428, tightness of strap 430, and the amount of weight 300 providing resistance. This allows for adjustment to meet the needs of a specific user.

Figure 2:
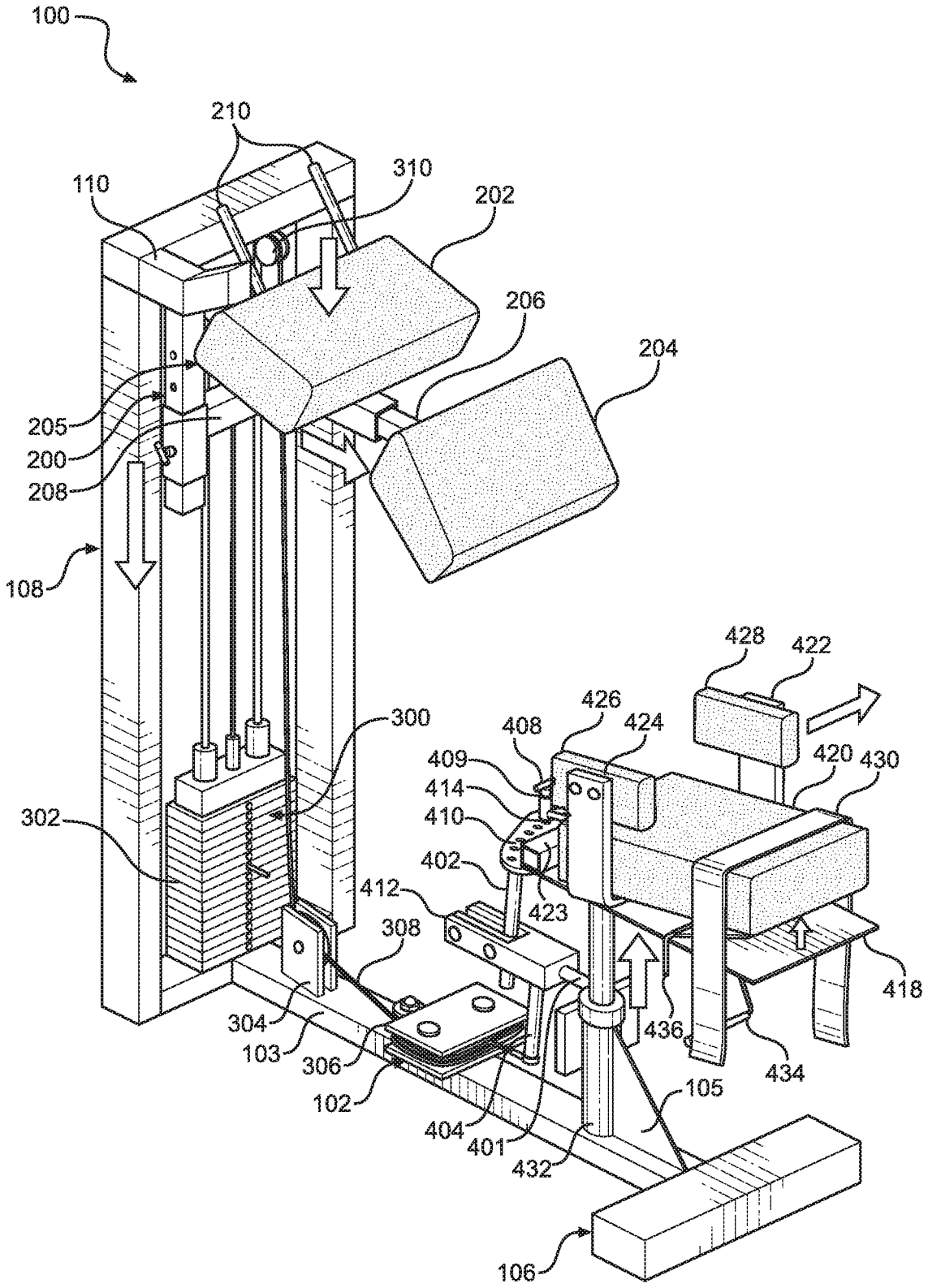
FIG. 2 is a perspective view of a preferred embodiment of the present invention showing adjustment of the chest and knee pad.

The arm pad 202 and the angled torso pad 204, as shown in FIG. 2, need not maintain the same relative height to each other although arm pad transverse bar 206 and angled trunk pad support bar 208 are fixed together at a point 205 on the vertical adjustment bar 200. The angled torso pad 204 and arm pad 202 are moved vertically together, but the heights of the torso pad 204 and the arm pad 202 may be adjusted separately via adjusting length of the transverse bar 206. The trunk support bar 208 is also able to extend or retract along the horizontal plane to accommodate differing body and chest sizes in a supportive position. The angled torso pad 204 may even support the users 101 lower trunk if the user 101 chooses to utilize it in that fashion. The user 101 will grip handles 210 to further support themselves and isolate movement to the hip and lower back portions of the body 530.

A preferred embodiment of the present invention will also provide a system of adjusting the height of the leg pad 420 to a comfortable and effective level for the user, preferably the user's knee height, but chosen height is typically dependent on the particular needs of a user. A preferred embodiment of the invention will do this through adjustments made to the leg pivoting section, as shown in FIG. 3. An adjustment can be made to the height of the leg pad 420 with or without user's leg 510 strapped to the leg rest 420 by the strap 430. To adjust the height of weighted leg pivot section, a piston controlling handle 434 is depressed which allows the user 101 to raise or lower the system by applying pressure to the leg rest 420 while the handle 434 is depressed. A separate handle 436 further controls the vertical angle of the leg rest 420, allowing the angle to change when handle 436 is depressed.

As shown in FIG. 3, first knee pad 426 and second knee pad 428 may be adjusted to fit the user's knee size as knee pad 426 and knee pad 428 are connected to their respective bars: bar 424 and bar 422. Therefore, the first knee pad 426 and second knee pad 428 can be adjusted to fit the user's knee when users engages the system. To further fit and support the user's leg 510 in the machine, the leg 510 may be strapped in place on the pad by leg strap 430. A leg 510 may be a prosthetic.

Figure 4:
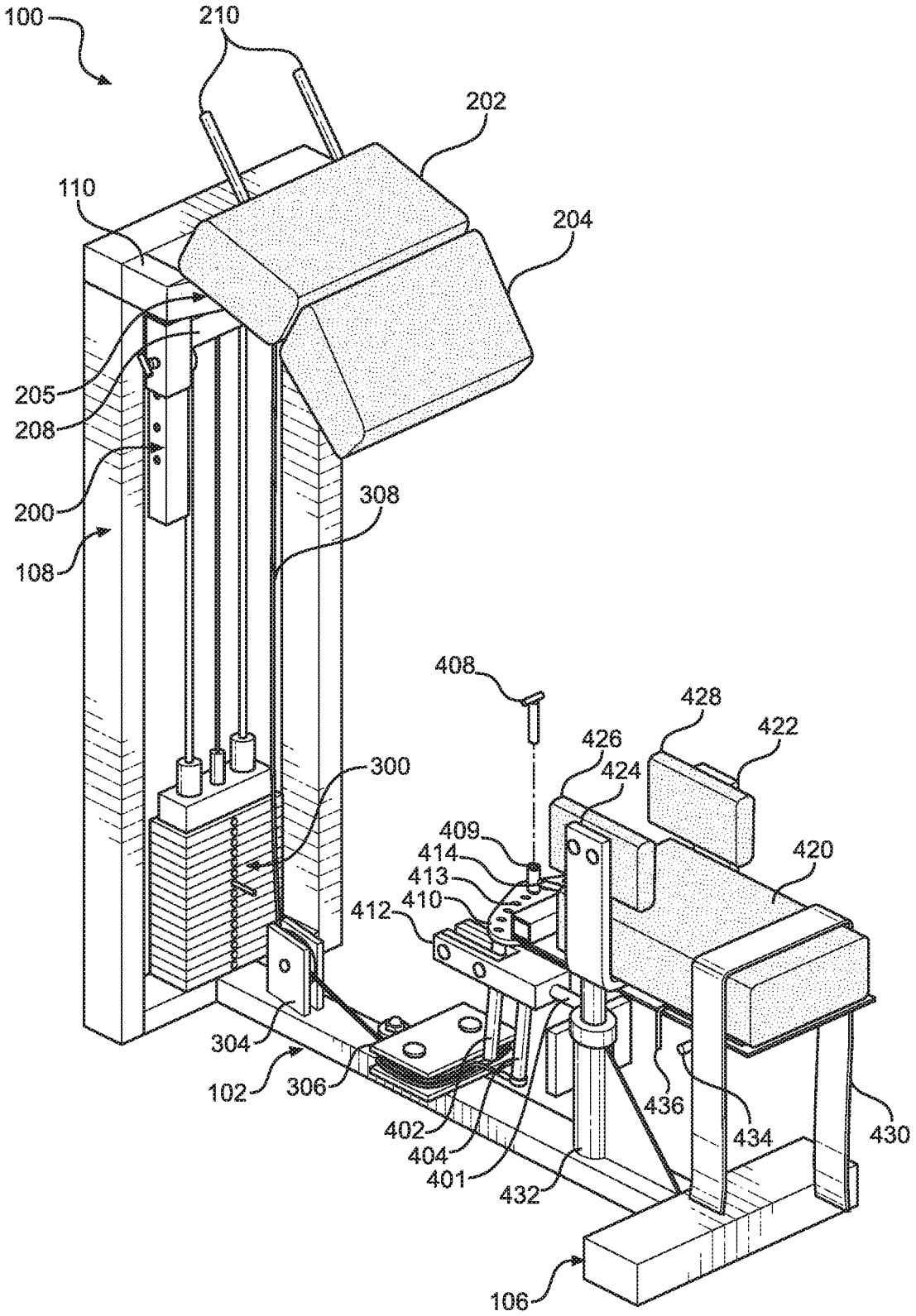
FIG. 4 is perspective view of a preferred embodiment of the present invention illustrating removal of the controlling pivot pin from its sheath for a range of motion adjustment of the pivot.

A preferred embodiment of the present invention creates a pivot point under the seat plate 418, at the point where hydraulic piston 433 connects to the plate. Since plate 418 is connected to pivot locking pin 408 by a bar 414, engaging the pivot locking pin 408 will generate the pivot of the plate 418 as well as first knee pad 426, second knee pad 428, leg rest 420, and leg strap 430 along with their respective parts, which are connected to the plate 418. As shown by FIG. 4, by pulling up on the pivot locking pin 408, pivot locking pin 408 is unsheathed from sheath 409, thus no longer slotting into adjustment plate 410 and the user 101 is free to pivot their leg 510 sans resistance. Once the user 101 has pivoted their leg 510 to a suitable starting location they can engage the pivot locking pin 408 into sheath 209 and a slot on adjustment plate 410. This engagement allows for the weighted resistance to be generated when a pivoting movement is made.

The starting position controls the body target of the exercise, if the leg 510 is freely pivoted to the right and then pivot pin 408 is engaged, weighted resistance will be applied every time the leg 510 pivots from the left to the right and back again, but if the pivot pin 408 is engaged in the middle, resistance will be generated in a pivot to the right and back to the middle or left and back to the middle instead of through one large sweeping arc. Changing the starting position affects the rotation of the hip and lower back area 530, thus providing the ability to target and deliver weighted resistance to hip and back area 530 via their respective muscle groups.

Figure 5:
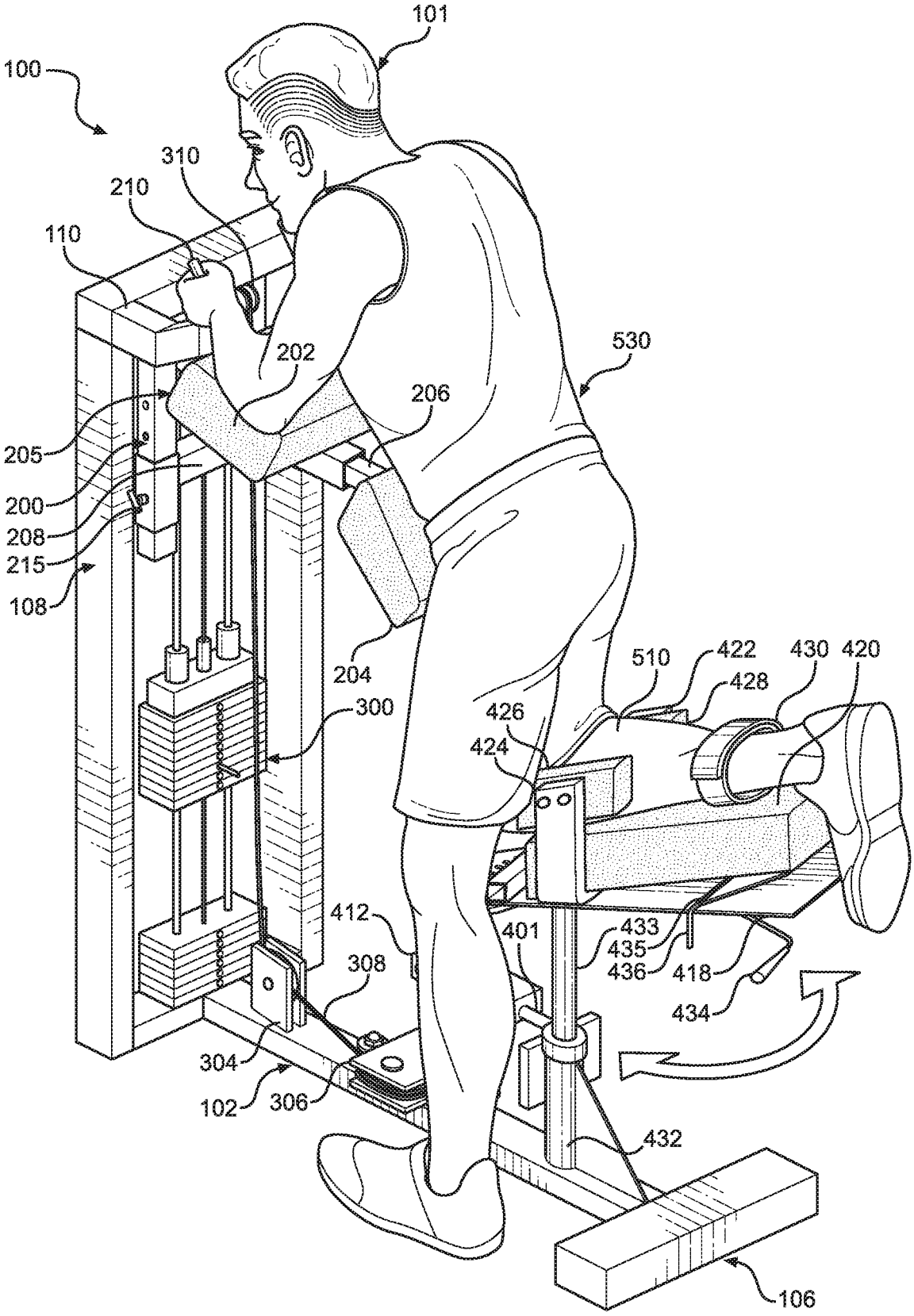
FIG. 5 is a perspective view of view of the present invention illustrating pivoting movement of the user's leg when performing a leg movement exercise.

As shown in FIG. 5, the adjustment plate 410 pivots with the seat plate 418 when the pivot locking pin 408 is engaged. The stabilizing rod 402 connected to the U-shaped bracket 412, which is connected to the cord guide 306 by cord attachment arm 404, is the mechanism by which the pivot affects the weight 300 movement. The U-shaped bracket 412 is configured so that the stabilizing rod 402 may be raised and lowered as hydraulic piston 433 lifts the seat plate 418. While the stabilizing rod 402 pivots with the plate 418, the cord attachment arm 404 is held rigidly vertical from the bracket 412 so that as the bracket 412 moves the cord attachment arm 404, the arm 404 moves in a horizontal plane thus moving the cord 308.

The band 308 passes parallel to base 102 until it reaches the pulley 304 which directs it upward parallel to the vertical rack 108 until it reaches the upper pulley 310 which directs it over the weight 300. Once over the weight 300, the upper pulley 310 directs it to the weights 300 where it is attached. Thus, by the cord attachment arm 404 rotating and pulling the band 308, the weights 300 are lifted in the vertical rack 108.

In the preferred embodiment of the present invention, the weighted hip and back exerciser is primarily aluminum, or other metal or metal alloy, or some combination thereof. However, an embodiment of the present invention, may be of lightweight but strong material and sections may be designed for easy removability for storage purposes. In the preferred embodiment of the present invention, adjustability allows one machine to target many locations of the hip and back area 530. However, a machine lacking adjustability is suitable for use where the targeted area has been predefined and the user 101 has selected a nonadjustable machine, otherwise built to this specification, which lacks adjustability but matches the need of the user 101.

Many changes and modifications can be made in the security system according to the present invention without departing from the spirit thereof. I therefore pray that my rights to the present invention be limited only by the scope of the appended claims.

I claim:

1. An exercise apparatus for targeting gluteal muscles and lower back muscles of a user, the apparatus comprising:

a base having an elongated base member and a frame cross member attached transversely to the elongated base member at a base first end;

an upright rack comprising a pair of parallel vertical frame members and a pair of transverse horizontal frame members secured between upper and lower ends of the vertical frame members to form a generally rectangular frame, the upright rack attached to a second end of the elongated base member;

an extension bar cantilevered from an upper horizontal frame member of the upright rack, the extension bar carrying an adjustment arm comprising a hollow body with a plurality of vertically spaced-apart openings, the adjustment arm attached to a free end of the extension bar, extending vertically downwardly therefrom;

a trunk support bar secured to the adjustment arm by a vertically movable sleeve attached to the trunk support bar;

a torso assembly transverse bar cantilevered from the trunk support bar;

a vertically adjustable and angled torso support assembly secured to the torso assembly transverse bar;

a weight assembly supported by the upright rack;

a pivotally and vertically adjustable leg rest assembly mounted on the elongated base member a distance from the torso support assembly, said leg rest being operationally connected to the weight assembly; and a hydraulic unit mounted between the leg rest assembly and the elongated base member, the hydraulic unit supporting the leg rest assembly;

wherein the vertically movable sleeve is configured to surround the adjustment arm and slidably move along the adjustment arm vertically adjusting a position of the torso support assembly.

2. The apparatus of claim 1, wherein the torso support assembly comprises an arm pad and a separate spaced-apart torso pad.

3. The apparatus of claim 2, wherein the torso assembly transverse bar is telescopically extendable moving the torso pad toward and away from the arm pad upon demand.

4. The apparatus of claim 1, further comprising a pulley assembly mounted between the leg rest assembly and the weight assembly.

5. An exercise apparatus for targeting gluteal muscles and lower back muscles of a user, the apparatus comprising:

a base having an elongated base member and a frame cross member attached transversely to the elongated base member at a base first end;

an upright rack attached to a second end of the elongated base member;

a weight assembly supported by the upright rack;

a vertically adjustable and angled torso support assembly secured to the upright rack;

a pivotally and vertically adjustable leg rest assembly mounted on the elongated base member a distance from the torso support assembly, said leg rest being operationally connected to the weight assembly; and a hydraulic unit mounted between the leg rest assembly and the elongated base member, the hydraulic unit supporting the leg rest assembly;

wherein the leg rest assembly comprises a seat plate attached to the hydraulic unit, a leg pad mounted on the seat plate, a pivotal adjustment plate mounted on the seat plate forwardly of the leg pad, and wherein a pulley assembly is mounted between the weight assembly and the leg rest assembly.

6. The apparatus of claim 5, wherein the pivotal adjustment plate is provided with a plurality of spaced-apart openings formed along an arc, and wherein a removable locking pin is removably insertable into a desired opening allowing the user's leg to follow a desired swivel movement depending on a position of the locking pin.

7. The apparatus of claim 6, further comprising a horizontally-oriented U-shaped bracket positioned under the adjustment plate and a stabilizing rod secured to a bottom of the adjustment plate and extending at a right angle downwardly therefrom, the stabilizing rod passing through a channel formed by the U-shaped bracket, and wherein side-to-side movement of the stabilizing rod is restricted by the sides of the U-shaped bracket, and wherein pivotal movement of the leg rest assembly is limited by the locking pin engaged in any of the adjustment plate openings and by the stabilizing rod moving within the confines of the U-shaped bracket channel.

8. The apparatus of claim 7, wherein the pulley assembly comprises an upper pulley mounted on the upright rack above the weight assembly, a lower pulley mounted on the elongated base member, a cord guide mounted below the U-shaped bracket, and a flexible cord stretched between the weight assembly and the leg rest assembly, the flexible cord being guided by the upper pulley, the lower pulley and the cord guide.

9. The apparatus of claim 8, wherein the pulley assembly further comprises a cord attachment arm secured to the U-shaped bracket, and wherein one end of the cord is secured to the cord attachment arm.

10. The apparatus of claim 5, wherein a pair of knee pads are mounted on opposite sides of the seat plate, at least one of the knee pads being laterally movable toward and away from the leg pad.

11. The apparatus of claim 5, wherein a leg pad lifting member is mounted between the leg pad and the seat plate such that at least one end of the leg pad can be lifted away from the seat plate, while maintaining attachment to the seat plate.

12. The apparatus of claim 5, further comprising a flexible strap attached to the leg pad, the strap being configured to be placed about the user's leg and secure a position of the leg on the leg pad.

13. A method of exercising gluteal muscles and lower back muscles of a user, comprising the steps:

providing an exercise apparatus comprising:

a base having an elongated base member and a frame cross member attached transversely to the elongated base member at a base first end;

an upright rack comprising a pair of parallel vertical frame members and a pair of transverse horizontal frame members secured between upper and lower ends of the vertical frame members to form a generally rectangular frame, the upright rack attached to a second end of the elongated base member;

an extension bar cantilevered from an upper horizontal frame member of the upright rack, the extension bar carrying an adjustment arm comprising a hollow body with a plurality of vertically spaced-apart openings, the adjustment arm attached to a free end of the extension bar, extending vertically downwardly therefrom;

a trunk support bar secured to the adjustment arm by a vertically movable sleeve attached to the trunk support bar;

a torso assembly transverse bar cantilevered from the trunk support bar;

a vertically adjustable and angled torso support assembly secured to the torso assembly transverse bar;

a weight assembly supported by the upright rack;

a pivotally and vertically adjustable leg rest assembly mounted on the elongated base member a distance from the torso support assembly, said leg rest being operationally connected to the weight assembly; and a hydraulic unit mounted between the leg rest assembly and the elongated base member, the hydraulic unit supporting the leg rest assembly;

wherein the vertically movable sleeve is configured to surround the adjustment arm and slidably move along the adjustment arm vertically adjusting a position of the torso support assembly;

vertically adjusting the torso support assembly such that the user's torso and arms are supported by the torso support assembly;

vertically adjusting the leg rest assembly;

securing a user's leg in the leg rest assembly; and pivotally moving the leg rest assembly against resistance of the weight assembly, thereby exercising gluteal muscles and lower back muscles of the user.

14. The method of claim 13, wherein the leg rest assembly comprises a seat plate, a leg pad mounted on the seat plate, and a pair of knee pads mounted on opposite sides of the seat plate, the method comprising a selective step of laterally moving at least one of the knee pads toward and away from the leg pad.

15. The method of claim 14, comprising a step of providing a pivotal adjustment plate secured to the seat plate, the pivotal adjustment plate being provided with a plurality of spaced-apart openings formed along an arc, and wherein a removable locking pin is removably insertable into a desired opening allowing the user's leg to follow a desired swivel movement depending on a position of the locking pin.

16. The method of claim 13, wherein the torso support assembly comprises an arm pad and a separate spaced-apart torso pad.

* * * * *